United States Patent [19]

Moll

[11] Patent Number: 4,512,562

[45] Date of Patent: Apr. 23, 1985

[54] FEEDER TABLE WITH PHOTO-SCAN CONTROLLED BELT MOTOR

[76] Inventor: Richard J. Moll, c/o Dick Moll & Sons, 415 Constance Dr., Warminster, Pa. 18974

[21] Appl. No.: 621,533

[22] Filed: Jun. 18, 1984

Related U.S. Application Data

[63] Continuation-in-part of Ser. No. 138,713, Apr. 9, 1980, abandoned.

[51] Int. Cl.[3] ..... B42C 1/00

[52] U.S. Cl. ..... 270/45; 271/12; 271/13; 271/98; 271/171; 271/150; 271/155

[58] Field of Search ..... 270/45; 271/34–35, 271/226, 98, 236, 171, 242, 150, 248, 155, 253, 12–13, 258–259, 265–270; 198/300, 301, 855, 857, 862

[56] References Cited

U.S. PATENT DOCUMENTS

| | | | |
|---|---|---|---|
| 1,888,194 | 11/1932 | Broadmeyer | 271/98 |
| 2,821,384 | 1/1958 | Mendes | 271/12 X |
| 2,926,907 | 3/1960 | Bromberg | 271/151 |
| 3,474,893 | 10/1969 | Morine | 198/813 X |
| 3,513,625 | 5/1970 | Eller et al. | 53/66 |
| 3,645,525 | 2/1972 | Ishihara et al. | 270/45 |
| 3,743,078 | 7/1973 | Pittoreau | 198/862 |
| 3,894,732 | 7/1975 | Muller | 271/155 |
| 4,052,051 | 10/1977 | Mersereau et al. | 271/155 |
| 4,223,882 | 9/1980 | Stocker | 270/45 |
| 4,236,631 | 12/1980 | Bowen et al. | 198/867 |

FOREIGN PATENT DOCUMENTS

| | | | |
|---|---|---|---|
| 1064534 | 9/1959 | Fed. Rep. of Germany | 271/12 |
| 2071623 | 9/1981 | United Kingdom | 271/98 |

*Primary Examiner*—E. H. Eickholt
*Attorney, Agent, or Firm*—Z. T. Wobensmith, III

[57] ABSTRACT

A portable feeder table for converting existing pile fed paper folding machines and the like to continuous fed machines, in which the table is portable, and includes a motor housing having height adjustment provisions, the table has a horizontal portion with a plurality of endless driven feed belts, a detector member for detecting the presence or absence of sheets of paper and connected to control the speed and advance of the feed belts, paper hold-down rollers carried on the folding machine, and a longitudinal guide plate carried on and transversely movable across the table.

7 Claims, 5 Drawing Figures

FEEDER TABLE WITH PHOTO-SCAN CONTROLLED BELT MOTOR

CROSS REFERENCE TO RELATED APPLICATIONS

This application is a continuation-in-part of my prior application Ser. No. 138,713, filed Apr. 9, 1980 entitled "Feeder Table for Paper Folding Machines And The Like," and now abandoned.

BACKGROUND OF THE INVENTION

1. Field of the Invention

This invention relates to a portable, self contained feeding table which is useful to convert existing pile fed paper folding machines to continuous feed.

2. Description of the Prior Art

Paper folding machines are well known in the art, with most of those currently available employing a feed board which carries a stacked pile of paper sheets to be folded by the folding machine, the feed board being elevated to bring the top of the stack to a location for pick off and introduction into the machine for folding. The use of a feed board restricts the quantity of sheets in the stacked pile of paper sheets to be folded, and frequent stoppage of the machine for replenishment of the pile is necessary, which greatly increases the time required to fold a quantity of paper which adds to the cost.

Various conveyors having endless belts advancing along a horizontal table have heretofore been proposed, but these are not suitable for use as a self contained feeder table for conversion of existing pile fed paper folding machines.

Eller et al., in U.S. Pat. No. 3,513,625 shows an interleaving system for sheet material stacking apparatus which includes a flat table having parallel belts. The sheets S have sheets P of protective material interleaved and thereafter are stacked. The sheets S are supplied to the belts 26 at the left end of FIG. 1, and advanced along the belts 98. The sheets P, supplied from a roll 38 are severed by knives 108 and 109 and are delivered to the right ends of the belts 98 to mate with the sheets S.

A light source 195 and photo-sensitive element adjacent thereto detect the leading edge S1 of a sheet S, to activate the nip rolls 102 and 103 to advance a strip P for subsequent cutting, the actuation of the cutter roll 106 being controlled by passage of the trailing edge S-2, reestablishment of the light beam B and activation of the light sensitive elements.

Eller et al. does not suggest a portable self-contained feeder table useful to convert presently existing pile fed paper folding machines to continuous feed.

Morine, in U.S. Pat. No. 3,474,893 shows a portable self contained horizontal conveyor for bakeries and the like, which is not suitable for the same character of use as the feeder table of the present invention, since it lacks a side guide for the paper to be advanced, which is adjustable for width, which is not adjustable as to height to accommodate different paper folding machines, which does not have any shut-off provisions in the event of failure of paper supply, and which does not otherwise guide and control the advance of the paper to be folded.

Bromberg, in U.S. Pat. No. 2,926,907 shows apparatus for folding and handling newspapers and the like, which has an elevated hopper 48 for receiving a stack of newspapers, which are advanced downwardly around a drum 45, and also around a smaller drum and onto a wide belt 61, for transfer by suction cups 73*a* onto a belt 82. No height varying provisions are available in Bromberg, no delivery of fanned paper sheets to a paper folding machine, and no detector member for detecting and controlling the feeding of fanned paper sheets.

The apparatus of my invention converts a pile fed paper folding machine into a continuous feed machine providing many advantages not found in the prior art.

SUMMARY OF THE INVENTION

In accordance with the invention a portable feeder table is provided for use in combination with presently existing pile fed paper folding machines to convert them to continuous feed, and which includes a housing with a motor mounted therein, the housing being adjustable as to height, to which a table is mounted which has conveyor belts movable therealong with provisions for motor control controlling the successive advance of fanned sheets carried thereon to be advanced to a paper folding machine for folding.

It is the principal object of the invention to provide a portable paper feeder table which may be used with presently existing pile fed paper folding machines for more rapid and continuous feeding of paper sheets, and without the necessity for modifying or changing the paper folding machine with which it is used.

It is a further object of the invention to provide a portable feeder table for use with presently existing pile fed paper folding machines, and which is capable of utilizing the air pressure-vacuum paper pick up mechanism on the paper folding machine as it is presently installed.

It is a further object of the invention to provide a portable feeder table for use with presently existing pile fed paper folding machines, with which variable linear delivery speed of the paper sheets to be folded is provided, to match the speed of the paper folding machine with which it is used.

It is a further object of the invention to provide a portable feeder table for feeding sheets of paper to a folding machine, which is provided with a detector to determine the presence of sheets of paper to be delivered for folding.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
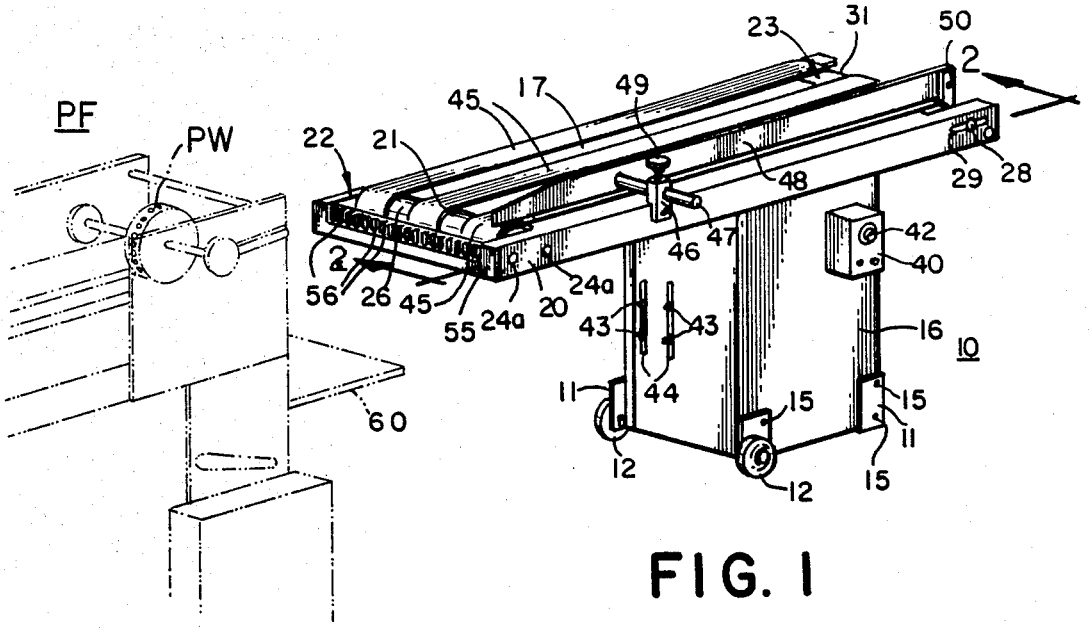
FIG. 1 is a side elevational view of the paper feeder table of the invention prior to use and with portions of a pile fed paper folding machine with which the feeder table is to be used being shown in phantom.
Figure 2:
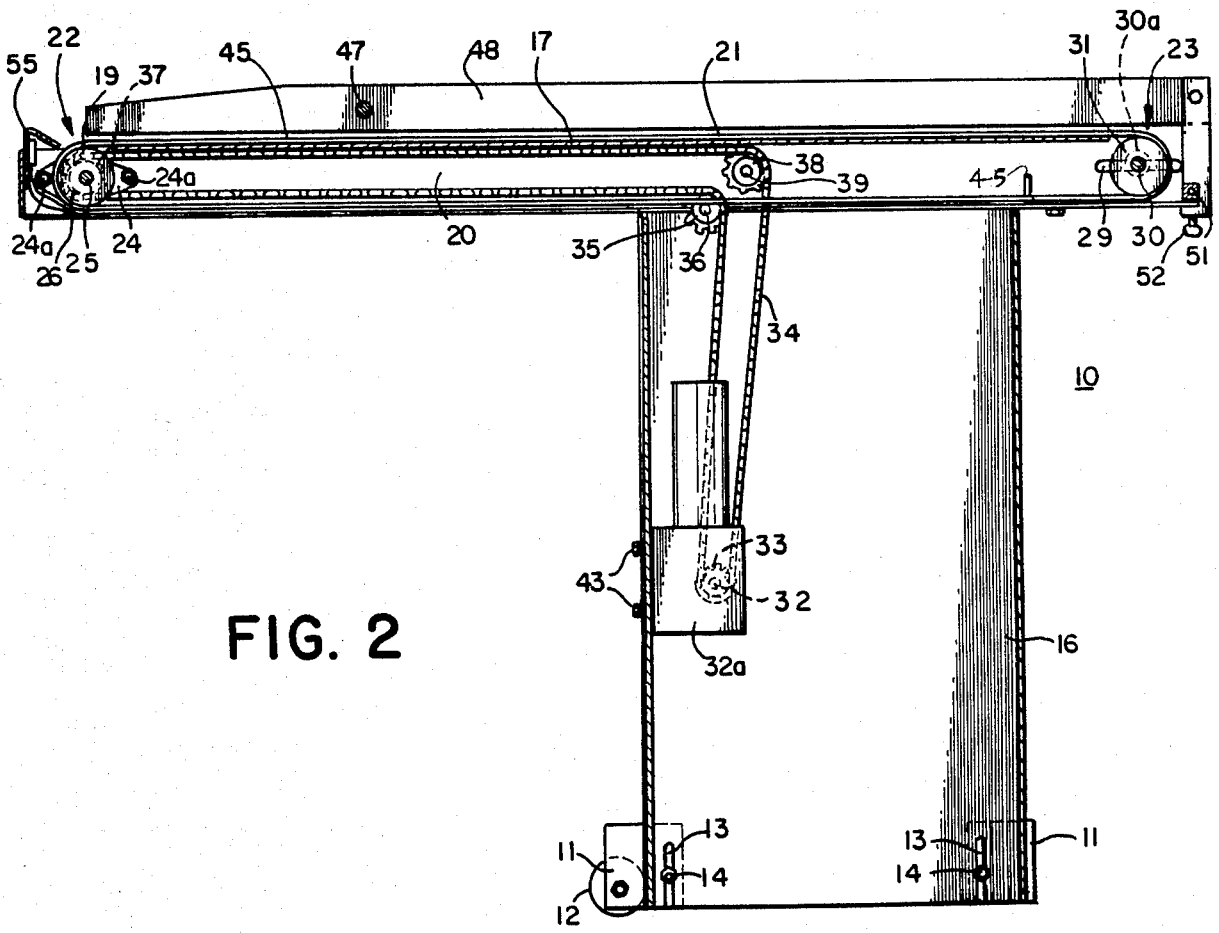
FIG. 2 is a vertical sectional view, taken approximately on the line 2—2 of FIG. 1.
Figure 3:
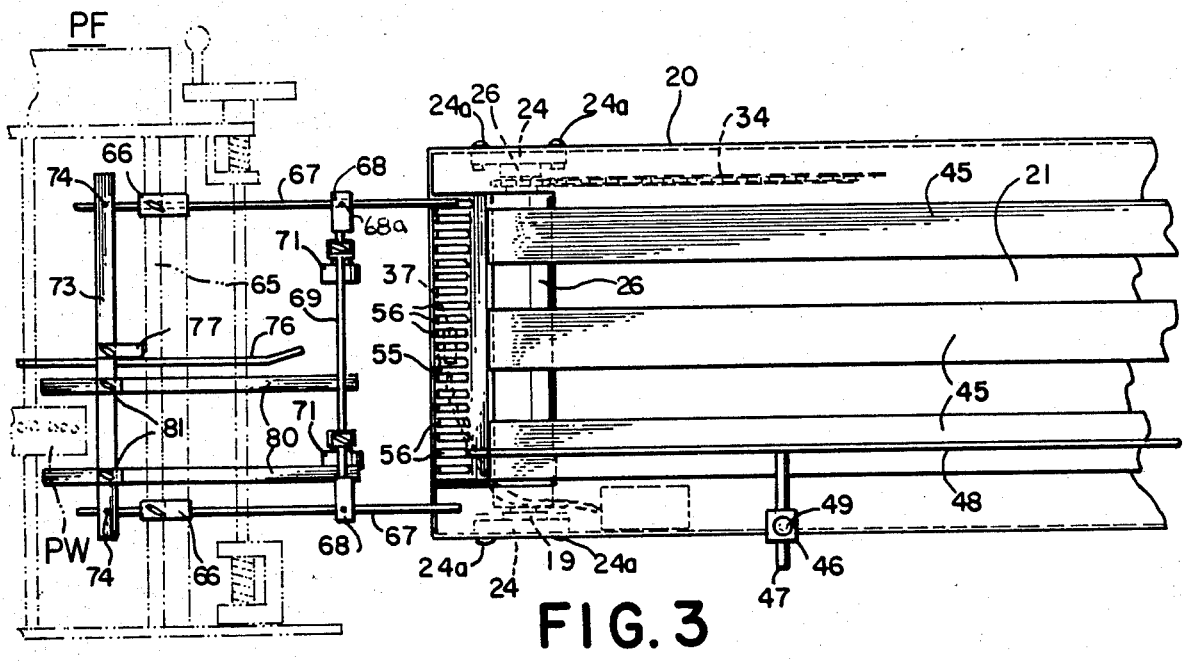
FIG. 3 is a top plan view of the feeder table of FIG. 1.
Figure 4:
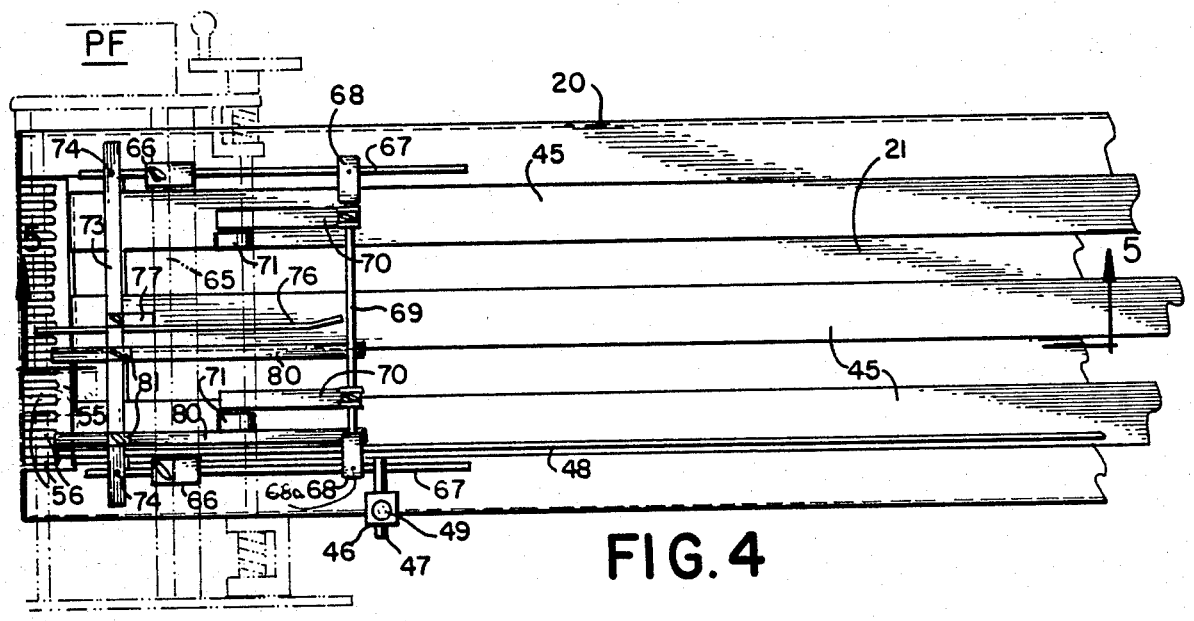
FIG. 4 is a view similar to FIG. 3 but showing the feeder table of the invention in place ready for use in a pile fed paper folding machine.
Figure 5:
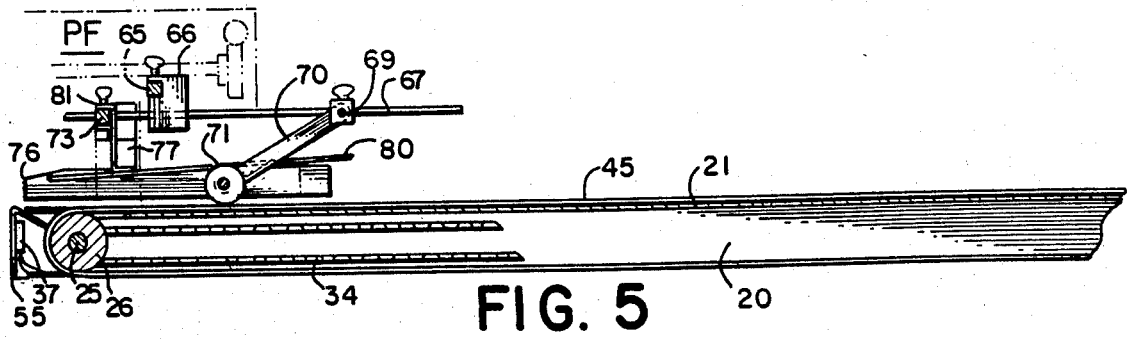
FIG. 5 is a fragmentary vertical sectional view, taken approximately on the line 5—5 of FIG. 4.

It should, of course, be understood that the description and drawings herein are illustrative merely and that various modifications and changes can be made in the structure disclosed without departing from the spirit of the invention.

DESCRIPTION OF THE PREFERRED EMBODIMENT

Referring now more particularly to the drawings, a motor housing 10 is provided, in the form of a box, which serves as a supporting frame with height adjusting plates 11 thereon, one opposite pair of which carries rotatable supporting wheels 12, which permit the housing 10 to be tipped and easily moved to a location for use. The housing 10 has vertical slots 13 with bolts 14 therein and which have nuts 15 thereon. The bolts 14 extend through opposite side walls 16 of the housing 10, so that the plates 11 can be raised or lowered as desired to position the bolts 14 at the desired elevation in the slots 13 for clamping by the nuts 15.

A table 17 is provided supported by the housing 10, which has side walls 20, a horizontal portion 21 between the rails 20, and with cut-away portions 22 and 23.

The side walls 20, at the left hand or delivery end as seen in FIG. 1, have flange bearings 19 carried on plates 24 mounted thereto by bolts 24*a*, for a shaft 25 carrying a driven roller 26.

The side walls 20, at the right hand or input end as seen in FIG. 1, have a shaft 24 carried in plates 27, which are retained by bolts 28 in slots 29 in the side walls 20. The shaft 30 has bearings 30*a* thereon rotatably engaged with an idler roller 31.

In order to drive the roller 26 a motor shaft 32 is provided, preferably driven by a variable speed motor 32*a*. The shaft 32 has a sprocket 33 secured thereto which is engaged by a driving chain 34. The chain 34 preferably extends over an idler sprocket 35 on a shaft 36 supported in the housing 10, then around a sprocket 37 on the shaft 25 to drive the roller 26, then beneath the horizontal portion 21 and around an idler sprocket 38 on a shaft 39 supported in the side wall 20 and thence back to the sprocket 33.

The housing 10 also carries a control box 40 which has an on-off power switch 41, and a knob 42 which is connected to a suitable resistance element (not shown) to control the speed of the variable speed motor 32*a*.

In order to maintain proper tension on chain 34, motor 32*a* can be moved vertically by mounting bolts 43 carried in slots 44 in housing 10.

The rollers 26 and 31 have a plurality of spaced endless belts 45 therearound, with the upper runs of the belts 45 extending along the top face of the horizontal portion 21, which are restrained from sidewise movement by belt guide plate 45 which extends between side walls 20.

In order to maintain the proper tension in the belts 45 the plates 27 carrying the shaft 30 may have the bolts 28 in slots 29 moved longitudinally until the desired tension is obtained.

One of the side walls 20 has a bracket 46 secured thereto, which carries a rod 47 to which a longitudinal guide plate 48 is removably secured by clamping screw 49 and movable transversely across table 17. The guide plate 48 is also secured to a bracket 50, carried on and movable along a bar 51, which is fastened to and extends between the side walls 20 at the input end. The bracket 50 carries a clamp screw 52 which can be tightened to retain the plate 48 at the desired transverse location on bar 51.

The table 17 at the delivery end has a fixed transverse nose plate 55 fastened thereto, which is provided with a plurality of cut-outs 56 to permit air flow therebetween from an air source under pressure (not shown) to flutter the paper sheets (not shown) for pick off as described below.

On the underside of the plate 55 and extending below one of the cut-outs 56 a scanner head 57 is provided, which detects the presence of a load of paper to be delivered for folding and through electrical circuitry (not shown) activates the motor 32*a* to advance the belts 45 and the sheets of paper thereon (not shown) for folding. The scanner head 57 associated circuitry and controls can be of any type but preferably are as described in my prior application Ser. No. 528,438, filed Sept. 1, 1983 entitled "Apparatus For Detecting And Actuating The Feeding Of Paper In Paper Folding Machine And The Like".

In FIGS. 1, 3, 4, and 5, a portion of a pile fed paper folding machine PF is illustrated for which the feeder table of the present invention is particularly useful. The folding machine PF has a pick off wheel PW which may be of the vacuum air suction type, for advancing the sheets delivered by the feeder table 17 into the machine PF, the conveyor portion 21 and its belts 45 being at substantially the same height as the pick off wheel PW. The feed board 60 for conventional pile feeding has been placed in lowered out of the way position for use of the feeder table 17.

Any other suitable pick up structure for the sheets may, of course, be used in the paper folding machine PF.

The paper folding machine PF has a transverse rod 65 secured thereto which carries a pair of brackets 66 thereon each of which carries a longitudinal rod 67. The longitudinal rods 67 each have brackets 68 fastened thereto by clamping screws 68*a* which are engaged with a transverse rod 69 with a pair of arms 70 carried thereon, with rollers 71 on the ends thereof for contact with the tail end of the paper sheets being delivered for folding. An additional transverse bar 73 is provided fastened to rods 67 by clamping screws 74, and which includes an adjustable guide plate 76 carried thereon by bracket 77, which extends longitudinally for engagement with the edge of the paper being advanced, and a pair of paper hold-down shoes 80 are provided also mounted on bar 73 by clamping brackets 81.

The mode of operation will now be pointed out.

The paper to be advanced for folding (not shown) is loaded onto the belts 45 by placing properly spaced shingled paper sheets onto the belts 45, and with additional shingled sheets introduced below the previous sheets for continuous feeding, and the on-off switch 41 is actuated to control the motor shaft operation to move the belts 45. The advancing sheets are detected by the scanner head 57 which starts or stops the motor 32*a* to advance the sheets as needed. The movement is very rapid, and the sheets are fluttered by the action of the air from an air source (not shown) and further advanced by the air suction wheel PW into the paper folding machine PF for folding.

It will be noted that the sheets are guided transversely in their advance by the adjustable longitudinal paper guide plate 48 and the guide plate 76, while being restrained against undesired upward movement or displacement by the spaced rollers 71, and the hold-down shoes 80.

It should be noted that by tilting the table 17 and its supporting housing 10 the wheels 12 engage the supporting surface and permit movement to the desired location for use.

I claim:

1. In combination with a pile fed paper folding machine for folding sheets of paper or the like, which includes sheet pick up means, and hold down means on the machine the improvement which comprises a portable feeder table for continuously supplying said sheets for folding which includes a portable housing having therein a motor driven shaft, a single variable speed motor for driving said shaft, a horizontal longitudinally extending table carried by said housing, height adjusting members on the lower part of said housing for adjusting the height of the table to accord with the height of the receiving portion of the machine to which the sheets are to be delivered, said table having an input end and a delivery end, said table having transverse end rollers at said input end and said delivery end and a plurality of flat horizontally disposed spaced endless driving belts carried on said rollers and longitudinally movable along said table, said motor driven shaft being connected in driving relation to said roller at said delivery end, said table having along one side edge thereof a longitudinally extending movable guide plate for one side edge of the sheets to be advanced, said table having at the delivery end a transversely extending nose plate, and detector means responsive to the presence or absence of a pile of paper sheets for controlling the operation of said motor and the advance of sheets to said folding machine for folding.

2. Apparatus as defined in claim 1 in which said detector means include a scanning head and electrical circuitry means connected thereto and to said motor.

3. Apparatus as defined in claim 1 in which said hold-down members include rollers in engagement with a sheet to be advanced.

4. Apparatus as defined in claim 1 in which said hold-down members include elongated hold-down shoes in engagement with a sheet to be advanced.

5. Apparatus as defined in claim 1 in which an adjustable transversely movable guide plate is provided attached to said folding machine and engaging said other side edge of said sheets to be advanced.

6. Apparatus as defined in claim 1 in which belt tension adjusting means is provided in said frame for movement of said input end roller for engagement with said endless belts.

7. Apparatus as defined in claim 1 in which said delivery end nose plate is secured to said housing, said sheet pick up means includes a source of air under pressure, and a vacuum pressure pick up wheel mounted to said folding machine, and said transverse nose plate has a plurality of cut-outs to permit the introduction of air under pressure to flutter said sheets prior to pick up.

* * * * *